US011359405B2

(12) United States Patent
Misner

(10) Patent No.: US 11,359,405 B2
(45) Date of Patent: Jun. 14, 2022

(54) DOUBLE BITTED-REVERSIBLE KEY PLUG LOCK

(71) Applicant: The Eastern Company, Naugatuck, CT (US)

(72) Inventor: Michael O. Misner, Lake Villa, IL (US)

(73) Assignee: The Eastern Company, Naugatuck, CT (US)

( * ) Notice: Subject to any disclaimer, the term of this patent is extended or adjusted under 35 U.S.C. 154(b) by 215 days.

(21) Appl. No.: 16/439,033

(22) Filed: Jun. 12, 2019

(65) Prior Publication Data

US 2019/0383058 A1 Dec. 19, 2019

Related U.S. Application Data

(60) Provisional application No. 62/685,354, filed on Jun. 15, 2018.

(51) Int. Cl.

| | |
|---|---|
| ***E05B 29/00*** | (2006.01) |
| ***E05B 19/00*** | (2006.01) |
| ***E05B 9/04*** | (2006.01) |
| ***E05B 63/00*** | (2006.01) |
| ***E05B 35/10*** | (2006.01) |

(52) U.S. Cl.

CPC ..... *E05B 29/0046* (2013.01); *E05B 9/04* (2013.01); *E05B 19/0052* (2013.01); *E05B 29/0053* (2013.01); *E05B 35/10* (2013.01); *E05B 63/0056* (2013.01)

(58) Field of Classification Search

CPC . E05B 9/04; E05B 15/14; E05B 19/00; E05B 19/0041; E05B 19/005; E05B 29/00; E05B 29/0046; E05B 29/0053; E05B 29/0073; E05B 35/00; E05B 35/08; E05B 35/10; E05B 63/0056

See application file for complete search history.

(56) References Cited

U.S. PATENT DOCUMENTS 1,805,891 A * 5/1931 Shinn ..... B60R 25/04 70/492
1,990,934 A * 2/1935 Falk ..... E05B 9/086 70/369
2,061,456 A * 11/1936 Falk ..... E05B 9/086 70/369

(Continued)

*Primary Examiner* — Christopher J Boswell
(74) *Attorney, Agent, or Firm* — Leydig, Voit & Mayer, Ltd.

(57) ABSTRACT

A lock has a locked condition and an unlocked condition comprising a barrel with a circular bore having three splines. A cylindrical plug is adapted to reside in the bore. First, second and retaining tumblers are positioned in tumbler slots, with the first and retaining tumblers biased in one direction toward the first spline and the second tumbler biased in the opposite direction into the second spline. When a first key is inserted, the first and second tumblers are moved against the bias so they retract from the respective splines and the plug can be rotated from the locked and unlocked conditions. When a second key is inserted while in the unlocked condition, the first, second and retaining tumblers are moved so the respective tumblers are either positioned in the third longitudinal spline or fully retained in the plug and the plug can be retracted axially from the barrel.

12 Claims, 8 Drawing Sheets

(56) References Cited

U.S. PATENT DOCUMENTS

| | | | | | |
|---|---|---|---|---|---|
| 3,661,000 | A | | 5/1972 | Kerr | |
| 3,973,421 | A | * | 8/1976 | Patriquin | E05B 29/00 70/340 |
| 4,075,879 | A | * | 2/1978 | Christopher | E05B 29/00 70/337 |
| 4,630,457 | A | * | 12/1986 | Kincaid | E05B 29/00 70/337 |
| 4,715,201 | A | * | 12/1987 | Craig | E05B 9/086 70/369 |
| 4,825,672 | A | | 5/1989 | Rabinow | |
| 4,976,123 | A | * | 12/1990 | Ceron | E05B 9/086 70/369 |
| 5,018,376 | A | | 5/1991 | Lee | |
| 5,101,649 | A | * | 4/1992 | Duval | E05B 9/086 70/369 |
| 5,119,654 | A | * | 6/1992 | Ceron | E05B 9/086 70/369 |
| 5,182,929 | A | * | 2/1993 | Myers | E05B 19/00 70/337 |
| 5,235,832 | A | | 8/1993 | Lux et al. | |
| 5,265,455 | A | | 11/1993 | Grimmer | |
| 5,531,084 | A | | 7/1996 | Laabs et al. | |
| 5,964,110 | A | | 10/1999 | Crocco et al. | |
| 5,970,762 | A | * | 10/1999 | Myers | E05B 29/00 70/369 |
| 6,109,081 | A | | 8/2000 | Dimig et al. | |
| 6,263,713 | B1 | * | 7/2001 | Fantl | E05B 17/0004 70/383 |
| 6,295,850 | B1 | | 10/2001 | Anderson | |
| 6,532,782 | B2 | | 3/2003 | Chiu | |
| 6,701,761 | B1 | | 3/2004 | Chang et al. | |
| 6,968,717 | B2 | | 11/2005 | Suzuki et al. | |
| 8,146,395 | B2 | | 4/2012 | Zhu et al. | |
| 8,336,348 | B2 | | 12/2012 | Dalton et al. | |
| 8,621,901 | B2 | | 1/2014 | Bacon | |
| 8,689,596 | B2 | | 4/2014 | Katagiri et al. | |
| 9,728,351 | B2 | | 8/2017 | Schroll et al. | |
| 9,822,556 | B1 | | 11/2017 | Schroll | |
| 2003/0041637 | A1 | | 3/2003 | Prunbauer et al. | |
| 2003/0089148 | A1 | | 5/2003 | Ruan | |
| 2005/0132767 | A1 | | 6/2005 | Freck | |
| 2008/0047310 | A1 | * | 2/2008 | Yu | E05B 29/00 70/337 |

* cited by examiner

DOUBLE BITTED-REVERSIBLE KEY PLUG LOCK

CROSS REFERENCE TO RELATED APPLICATIONS

This patent application claims the benefit of U.S. Provisional Patent Application No. 62/685,354, filed Jun. 15, 2018, which is incorporated herein by reference in its entirety.

BACKGROUND OF THE INVENTION

The present invention is directed toward a key lock, and more particularly toward a plug key lock having ease of use, increased pick resistance and simple plug interchangeability, while being easily replaceable with at least some existing plug key locks.

BRIEF SUMMARY OF THE INVENTION

A lock has a locked condition and an unlocked condition comprising a barrel with a circular internal bore and a longitudinal axis, the bore having a first, a second and a third longitudinal spline, with the first and second longitudinal splines being radially opposed and the third longitudinal spline oriented intermediately to the first and second splines. A substantially cylindrical plug is adapted to reside in the bore, the plug having a substantially rectangular bore having right and left side walls. The plug also has a first, a second, and a retaining transverse spring pocket, each spring pocket having a bottom wall, and a first, a second and a retaining transverse tumbler slot, with the spring pockets and tumbler slots located sequentially along the longitudinal axis with the tumbler slots extending through the bore and the spring pockets alternating between a right side and a left side of the bore. First, second and retaining tumblers are slidably positioned in each respective tumbler slot, each tumbler having an internal opening having a wall and an arm, each arm extending into a respective spring pocket. A spring is mounted in each spring pocket between the bottom wall and a respective tumbler arm for biasing the tumbler radially outwardly with the first and retaining tumblers biased in one direction toward the first spline and the second tumbler biased in the opposite direction into the second spline with at least one of the first and second tumblers partially in their respective spline in the absence of a key. A first key having longitudinal side walls is adapted to extend into the plug bore and through the tumbler internal openings, the key also having a first and a second land, the lands located to interact with the first and second tumbler internal opening walls when the key is fully inserted into the plug bore. Wherein, when the first key is fully inserted, the first and second lands move the first and second tumblers against the bias of the respective springs so they retract from the respective splines and the plug can be rotated from the locked and unlocked conditions. A second key also having longitudinal side walls is adapted to extend into the plug bore and through the tumbler internal openings, the second key also having a first, a second and a third land, the lands located to interact with the first, second and retaining tumbler internal opening walls respectively when the key is fully inserted into the bore. Wherein, when the second key is fully inserted into the plug while in the unlocked condition, the first, second and third lands move the first, second and retaining tumblers so the respective tumblers are either partially positioned in the third longitudinal spline or fully retained in the plug and the plug can be retracted axially from the barrel.

In one embodiment, the retaining tumbler is located at least partly into the third longitudinal spline while the lock is in the unlocked condition and the second key fully inserted.

In one embodiment, the barrel has a fourth longitudinal spline radially opposed to the third longitudinal spline. The fourth longitudinal spline has a shoulder at its distal end and the retaining tumbler contacts the shoulder to retain the plug in the barrel when the plug is in the unlocked condition in the absence of the second key being fully inserted into the plug bore.

In one embodiment, the lock has a distance between the centers of two sequential tumbler slots of 0.079 inches. In another embodiment, the key of the lock of has a slope between any two successive lands of 80 degrees. In another embodiment, the width of each of the tumbler slots is less than the diameter of each of the spring pockets.

Further and alternative aspects and features of the disclosed principles will be appreciated from the following detailed description and the accompanying drawings. As will be appreciated, the principles disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

BRIEF DESCRIPTION OF THE DRAWINGS

FIG. 18 is a rear end view of barrel and plug of one embodiment through which FIG. 8 is a stylized cross section.

DESCRIPTION OF THE PREFERRED EMBODIMENT

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice versa without limiting the scope of the disclosure to the exact number or type of such elements unless set forth explicitly in the appended claims. The terms configured and configuration may be used herein to refer to a specified arrangement, or a structural size and shape.

Figure 1:
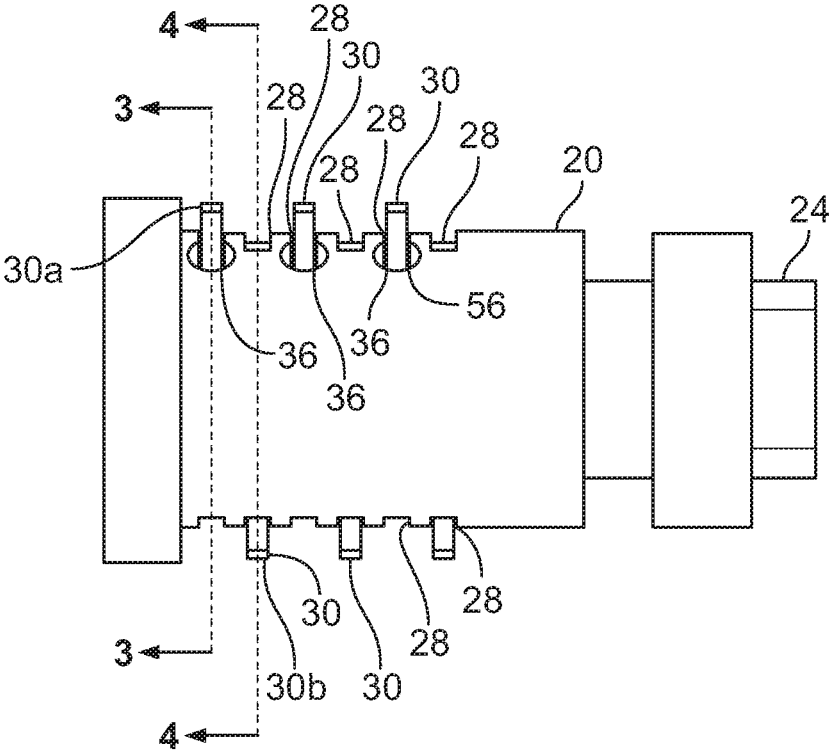
FIG. 1 is a side view of one embodiment of a plug for a double bitted lock of the invention.
Figure 2:
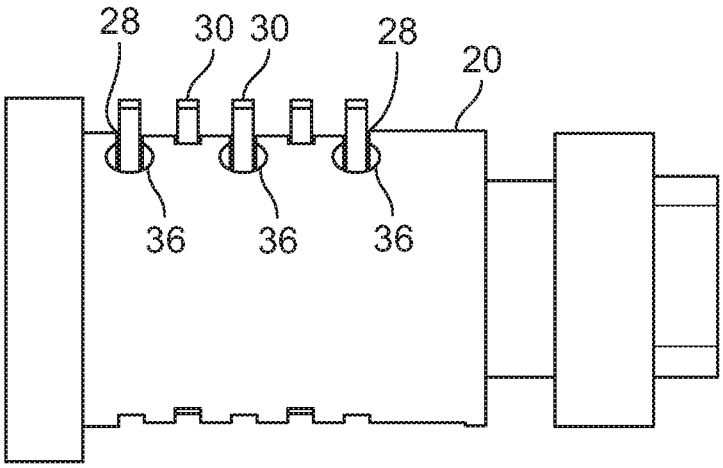
FIG. 2 (Prior Art)
FIG. 2 is a side view of a prior art plug for a single bitted lock.
Figure 3:
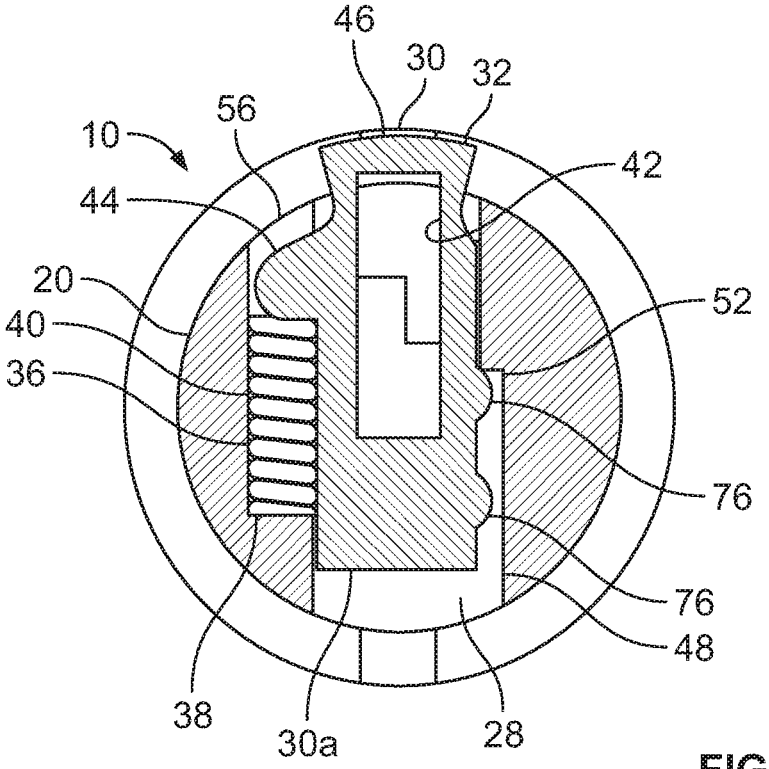
FIG. 3 is a stylized sectional view of FIG. 1 taken along line 3-3.
Figure 4:
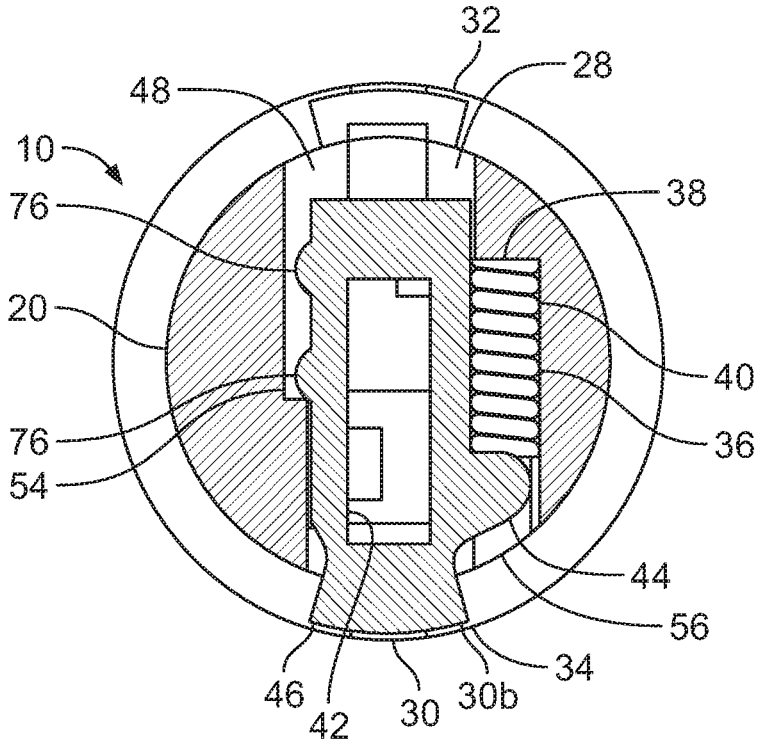
FIG. 4 is a stylized sectional view of FIG. 1 taken along line 4-4.

FIG. 1 shows a plug 20 for a double bitted-reversible key plug lock with three tumblers 30 extending upwardly from three tumbler slots 28 and three tumblers 30 extending downwardly from three tumbler slots 28. FIG. 2 shows a prior art five tumbler 30 single bitted plug 20 with all five tumblers extending upwardly. By using the inventive double bitted mechanism, six tumblers 30 can fit into about the same longitudinal length as the five tumbler single bitted mechanism of some prior art locks.

Figure 8:
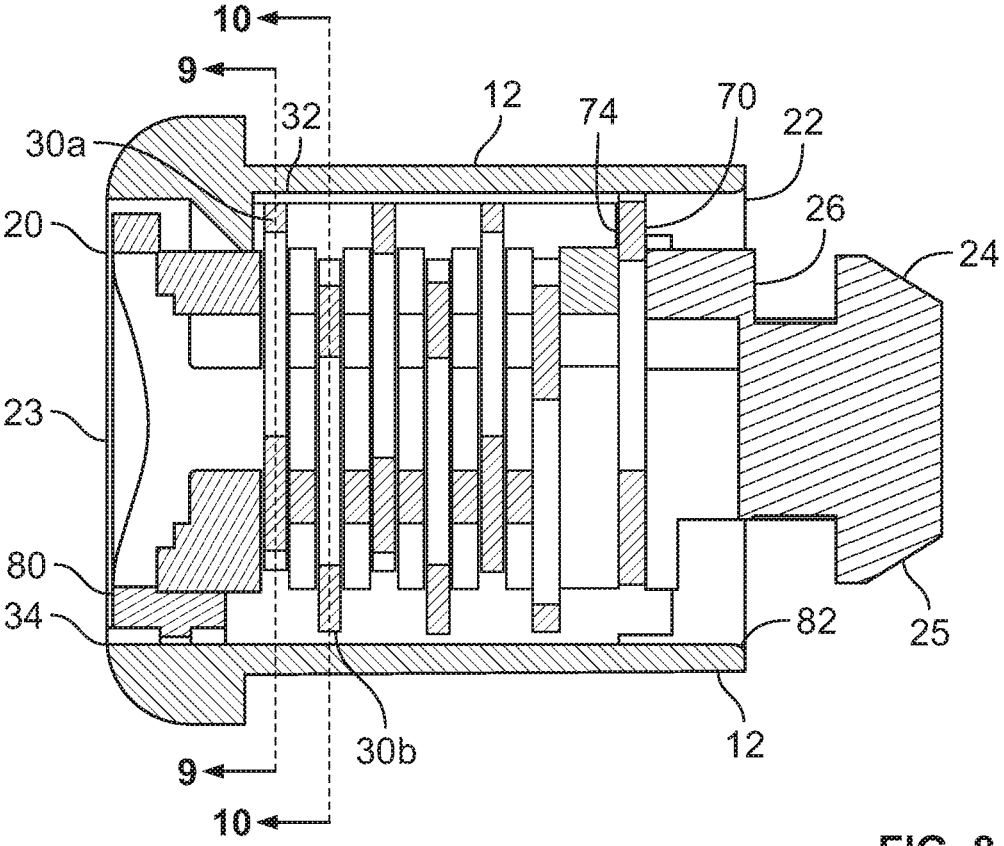
FIG. 8 is a stylized side sectional view of an embodiment of the lock with a plug in a barrel and no key inserted.
Figure 9:
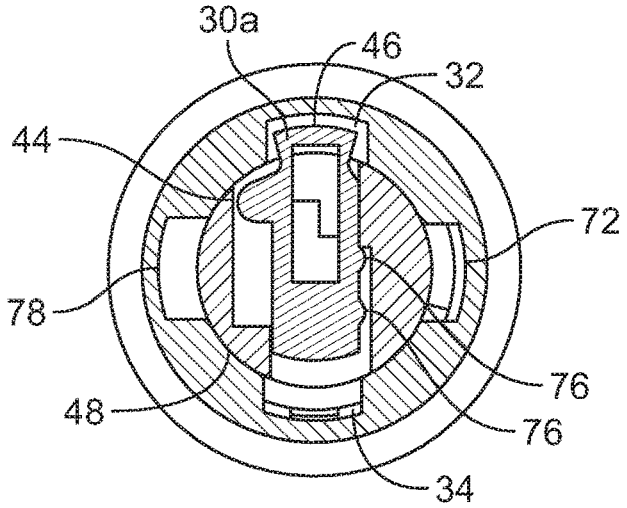
FIG. 9 is a stylized sectional view of the lock taken along line 9-9 of FIG. 8.
Figure 10:
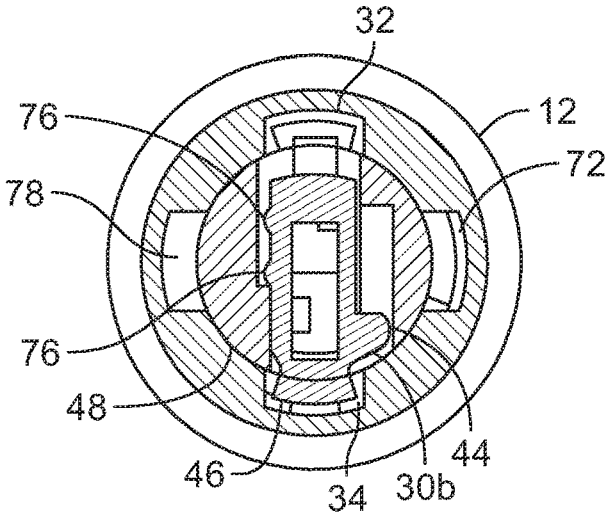
FIG. 10 is a stylized sectional view of the lock taken along line 10-10 FIG. 8.
Figure 15:
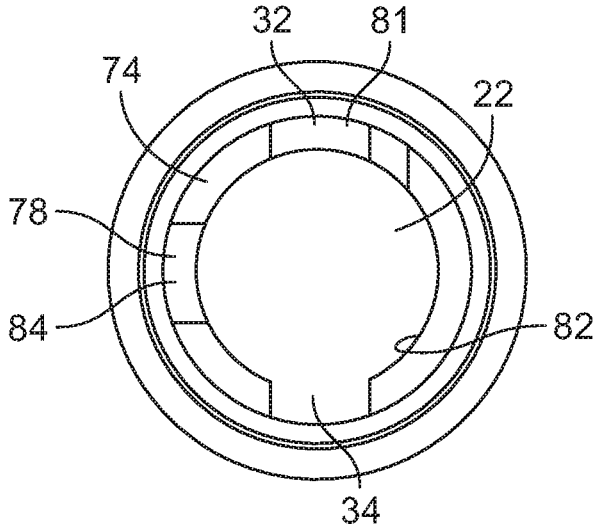
FIG. 15 is a rear end view of a barrel of one embodiment.
Figure 16:
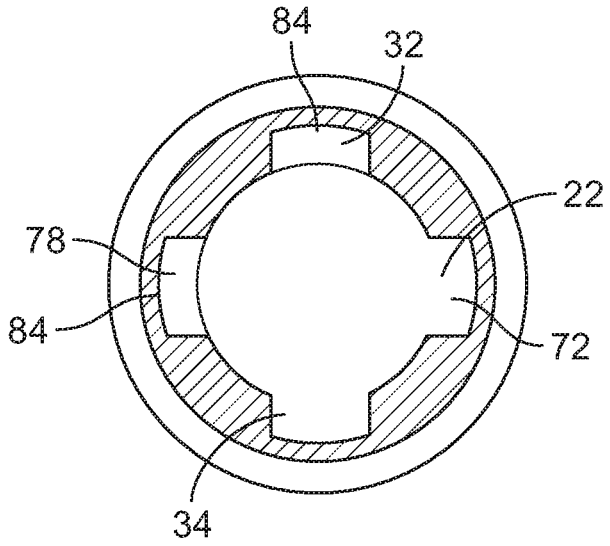
FIG. 16 is a sectional view of FIG. 14 taken along lines 16-16.
Figure 17:
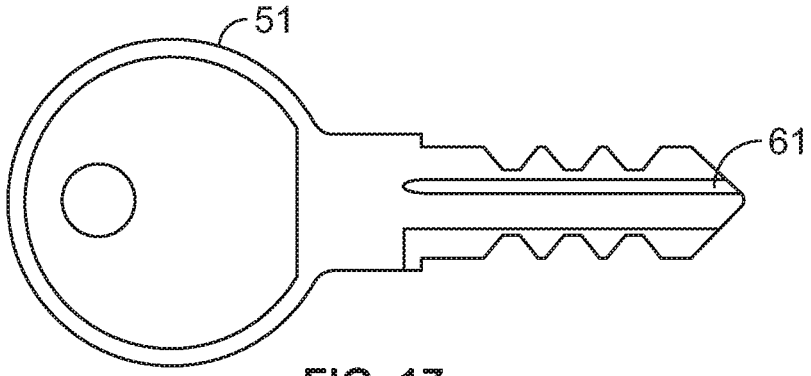
FIG. 17 is a side view of a plug or core removal key.

FIG. 8 shows the plug 20 positioned in a generally circular bore 22 of barrel 12. In use, the barrel 12 is fixed to a substrate such as a door or automobile accessory (not shown) in such a manner that it is not easily removable. The bore 22 has a major opening 23 at the front end 80 into which the plug 20 is inserted. The bore 22 also has an opening at its distal end 82 (see FIG. 15) through which the lock actuator 24 extends. The lock actuator 24 is an extension of the plug 20. When the plug 20 is able to rotate in the bore 22 with the appropriate first key 50 retracting the tumblers 30 from their respective splines in the locked or unlocked orientation, the actuator 24 can also rotate so that the head 25 of the actuator 24 aligns with a complementary shaped hole in the substrate to allow it to be retracted axially from the hole in the unlocked orientation or retained in the hole in the locked orientation. Alternatively, the head 25 of the actuator 24 can move a lever or slide to open the door or device to which the barrel is fixed and that had been desired to be locked. When the plug is oriented so the tumblers 30 are biased into the splines 72 and 78, the head 25 of the actuator 24 is in the locked orientation. Conversely, when plug is oriented so the tumblers 30 are biased into splines 32 and 34, the plug 20 is in the unlocked condition.

Figure 5:
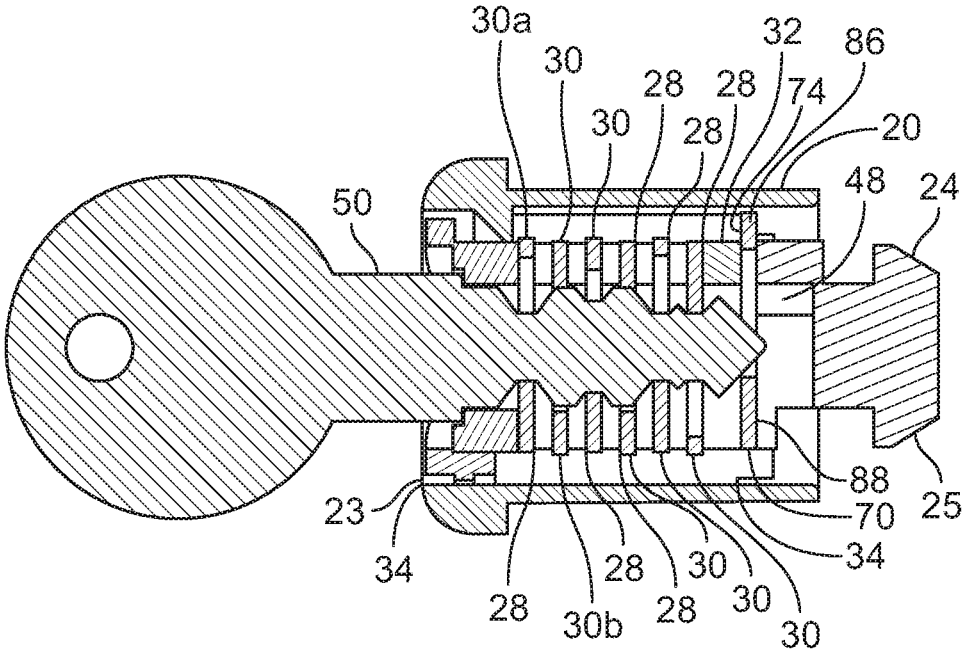
FIG. 5 is a partial sectional view of the double bitted lock of the invention with a standard key inserted.
Figure 6:
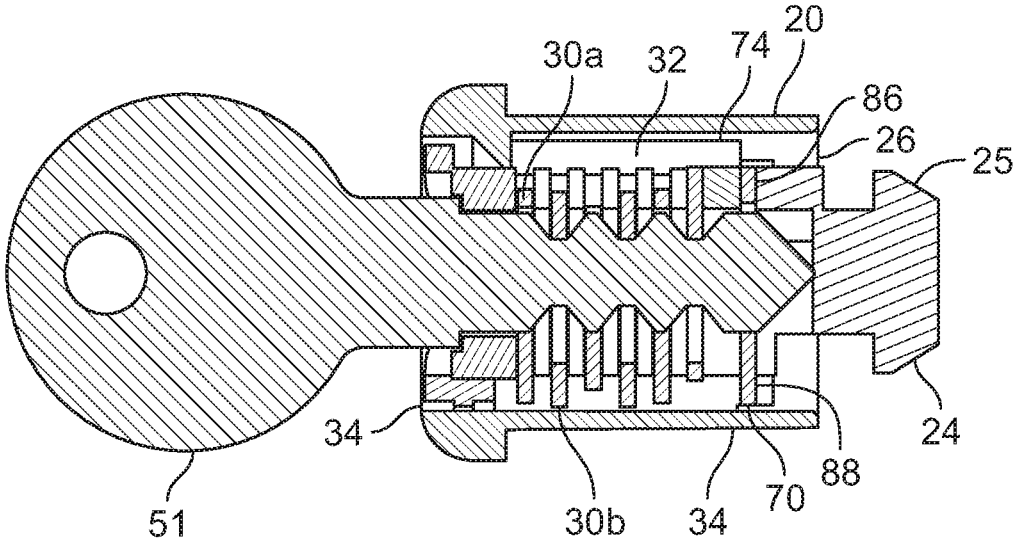
FIG. 6 is a partial sectional view of the double bitted lock of the invention with a plug core removal key inserted.

The plug 20 also has a longitudinally extending bore 48 into which a first or standard or normal operating key 50 can be inserted as shown in FIG. 5, and a second or plug removal key 51 can be inserted as shown in FIG. 6. The plug bore 48 is generally rectangular in cross section so the key shaft 60 fits snugly in the bore 48. In one embodiment, the plug bore 48 has stepped sidewalls 52 and 54, which cooperate with stepped sidewalls of the shaft 60 of the keys 50 and 51 to assist in warding or guiding the key 50 as it enters the bore 48. Alternatively, or additionally, the keys 50 and 51 may have longitudinal grooves 61 along each side of the key shaft 60 that cooperate with protrusions along the sidewalls of the plug bore 48 (not shown) to aid in warding or guiding the keys.

As seen in FIG. 8, the plug can also have a plug extension portion 26 extending distal of the sixth tumbler. Preferably, the extension portion 26 accommodates a retaining tumbler 70 that works in conjunction with the plug removal key 51 to allow the plug 20 to be retracted axially from the front of the barrel 12. The barrel bore 22 has a first 32 and second 34 longitudinal spline running along a majority of its length. When the plug 20 is oriented so the tumblers are biased toward splines 32 and 34, the plug is in the unlocked orientation. In a preferred embodiment, the splines 32 and 34 are diametrically opposed. When the proper key is not fully inserted into the bore 48, at least one of the tumblers 30 is biased into a spline to keep the plug 20 from rotating in the bore 18 so that the lock remains in either the locked or unlocked condition.

There is also a third spline 72 and a fourth spline 78 oriented, in one embodiment, at right angles to splines 32 and 34 in the bore 18 of the barrel 12. Other angles are also available and determine the relative angles between the locked and unlocked condition. When the plug is oriented so that the tumblers are biased toward either the third 72 or fourth 78 spline, the lock is in the locked condition.

Figure 18:
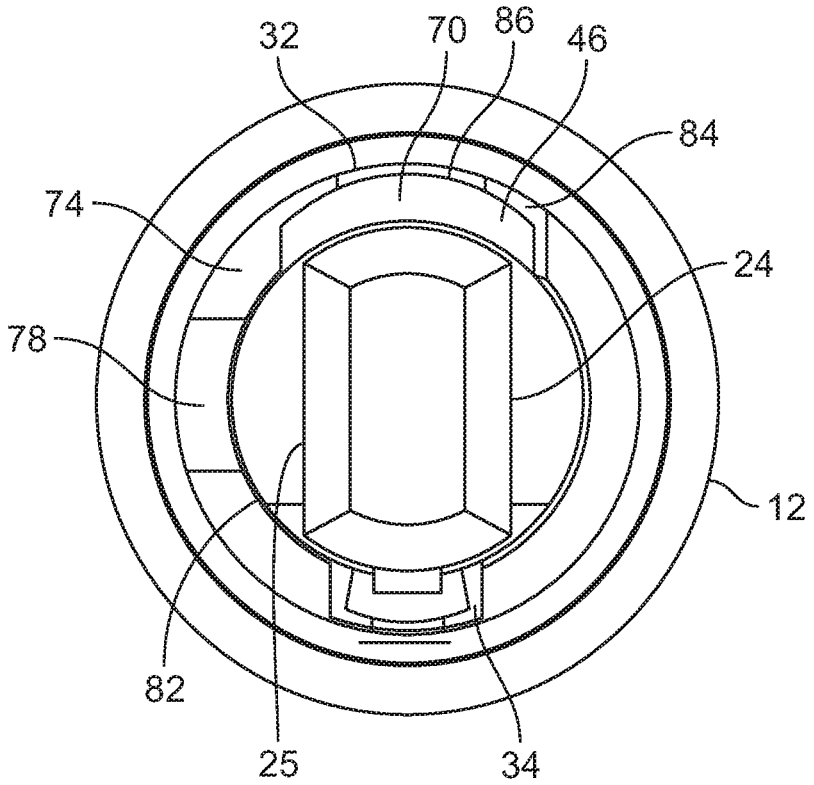

As shown in FIG. 18 in the unlocked condition, the first end 86 of the retaining tumbler 70 biased toward spline 32 is wider than spline 32 and into a space distal of spline 32. Accordingly, in the absence of the removal key 51, the first end 86 of the retaining tumbler contacts the shoulder or end wall 74 on either side of the distal end of spline 32 to retain the plug 20. Also, a wall stop 77 (See FIG. 13) is normal to the end wall 74 on one end and contacts a side of the first end 86 of the retaining tumbler to keep the plug from rotating more than 90 degrees. In addition, in one embodiment, the barrel has rotational end stops 90 (see FIG. 13) near the front end of the bore that cooperate with tangs on the plug (not shown) to limit rotation of the plug to 90 degrees between the locked and unlocked condition.

Figure 11:
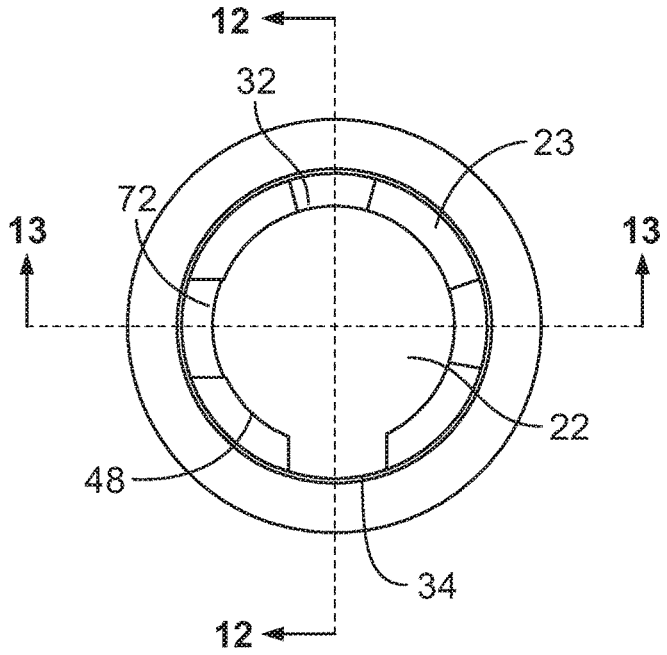
FIG. 11 is a front end view of a barrel of one embodiment.
Figure 12:
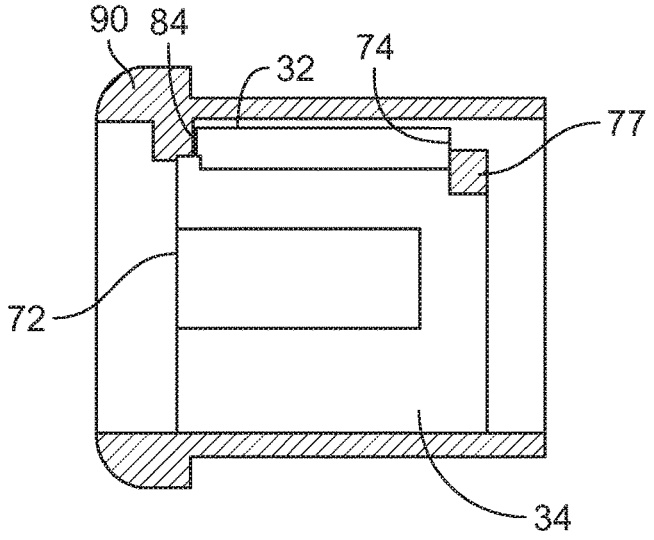
FIG. 12 is sectional view of FIG. 11 taken along lines 12-12.
Figure 13:
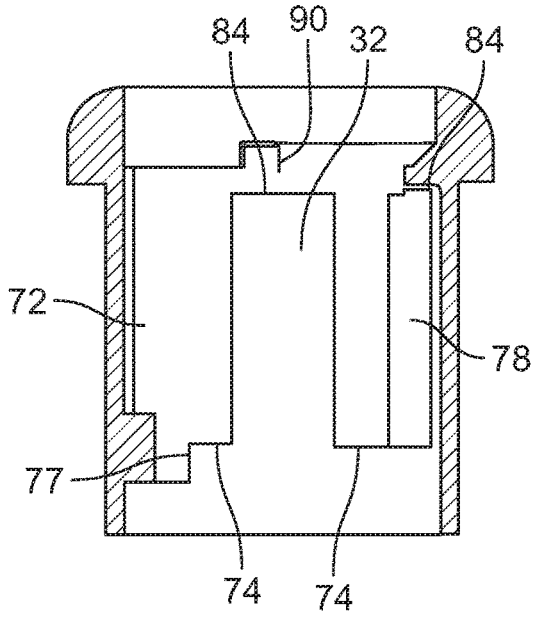
FIG. 13 is a sectional view of FIG. 11 taken along lines 13-13.
Figure 14:
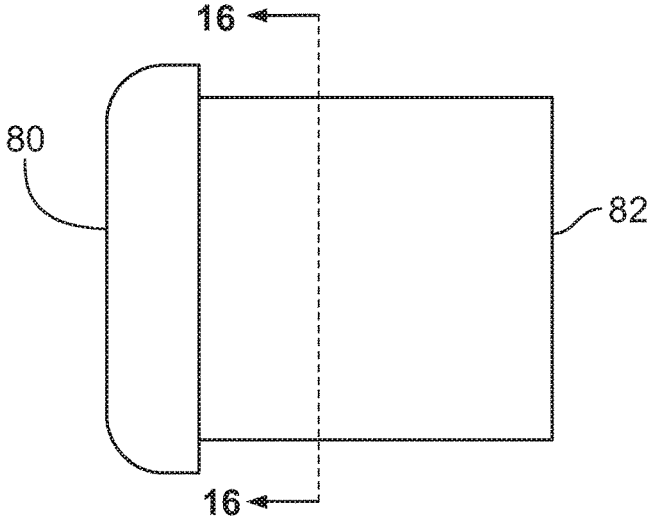
FIG. 14 is a side view of a barrel of one embodiment.

Moreover, as seen in FIGS. 11, 12 and 13, the splines 32 and 78 have front end walls 84 at their proximal ends so that if there is no operating key 50 or plug removal key 51 inserted, the first tumbler 30*a*, cannot move past the proximal end wall and the plug cannot be retracted. Accordingly, in normal operation, the plug 20 is retained in the barrel 12 by lock tumblers 30 and the retaining tumbler 70. Only when the plug 20 is in the open orientation and the plug removal key is fully inserted, is the first end 86 of the retaining tumbler retracted into the plug and the second end 88 of the retaining tumbler 70 moved into spline 34, and the plug can be extracted axially from the barrel 18. In addition, with the removal key 51 fully inserted, the lock tumblers 30 are either retracted into the plug 20 or positioned in spline 34 to allow the plug 20 to be extracted from the barrel 12.

FIG. 5 is similar to FIG. 8; only a standard or operating key 50 is inserted in the unlocked orientation. All of the regular tumblers 30 are retracted from splines 32 and 34 and the plug 20 is free to rotate in the barrel 12. Since this is the unlocked orientation, the plug could be rotated counter clockwise as seen from the front to the locked orientation. However, even though the lock tumblers 30 are all retracted, the plug 20 cannot be extracted from the barrel 12 because the first end 86 of retaining tumbler 70 remains behind the end wall 74 on either side of end of spline 32.

FIG. 6 is similar to FIG. 5 only with the plug removal key 51 biasing all of the standard tumblers 30 either into the plug or into spline 34 and the retaining tumbler 70 into spline 34. Since this is the plug removal spline, it does not have a stop at its proximal end. By pulling on the plug removal key 51 while the key is inserted and the plug is oriented in this unlocked condition, the plug can be withdrawn from the barrel. By this construction, a single plug removal key can be used to remove the plugs from multiple locks regardless of the combination of tumblers. For each individual lock, a standard key 50 with a special extension and land at the end of the shaft that would move the retaining tumbler would also allow the plug 20 to be extracted.

A further example of this feature for a single bitted lock is more fully described in U.S. Pat. No. 5,964,110 entitled Key Lock with Removable Plug and assigned to the common assignee as this application and which disclosure is incorporated herein.

As shown in FIGS. 3, 4, 9 and 10, extending transversely through tumbler slots 28 in the plug 20 are tumblers 30. In a preferred embodiment, the tumblers are self-staking. The depth and width of each tumbler 30, including the arm 44 and nubs 76 is slightly smaller than the depth and width of the slot 28 so each tumbler 30 is free to slide within its respective slot. Associated with each tumbler slot 28 is a spring pocket 36. Each spring pocket has a diameter and an end wall 38. Placed in each spring pocket is a spring 40. Each tumbler 30 has an interior opening 42 that is rectangular in shape, an arm 44 and an extension 46. Each tumbler is biased to extend radially outwardly by its associated spring 40 pushing between the end wall 38 and the tumbler arm 44. As can be appreciated by FIGS. 1, 3, 4, 5 and 6, sequentially the tumblers are biased in opposite directions along the longitudinal axis so, also sequentially, the spring pockets are located on opposite sides of the plug central bore 48.

In a preferred embodiment, the depth of the tumbler slots 28 is 0.043 inches while the diameter of the spring pockets is 0.082 inches. The tumbler slots 28 must all be spaced along the centerline of the plug bore 48, so a key can actuate the tumblers as it moves through the openings 42. However, the spring pockets can be staggered on either side of the bore 48 so that more tumblers 30 can be located along a given longitudinal length of the plug 20 than if the spring pockets were all on one side of the bore 48. Moreover, with the new parameters, six tumblers of the inventive lock can be located in 0.437 inches whereas only five tumblers were located in 0.429 inches in the prior art. In one embodiment, every other tumbler 30 is biased in the opposite direction, or independently opposed, while the spring pockets 36 are on opposite sides of the central bore 48 and also have open ends 56 on opposite sides of the central bore.

As shown in FIGS. 3, 4, 8, 9 and 10, when no key is present, a first tumbler 30*a* is biased upwardly by its associated spring to that the extension portion 46 of tumbler 30*a* extends into the first longitudinal spline 32. In similar, but opposite manner, a second tumbler 30*b* is biased downwardly so that its extension portion 46 extends into the second longitudinal spline 34. This is also true when the plug is oriented in the locked condition and the tumblers are biased into splines 72 and 78 in the absence of the proper key. If only one tumbler extension portion 46 extends into a spline 32 or 34 (or 72 or 78) the plug 20 cannot rotate within the bore 22. However, with more extension portions 46 extending into at least one of the splines, the lock becomes more pick resistant.

Figure 7:
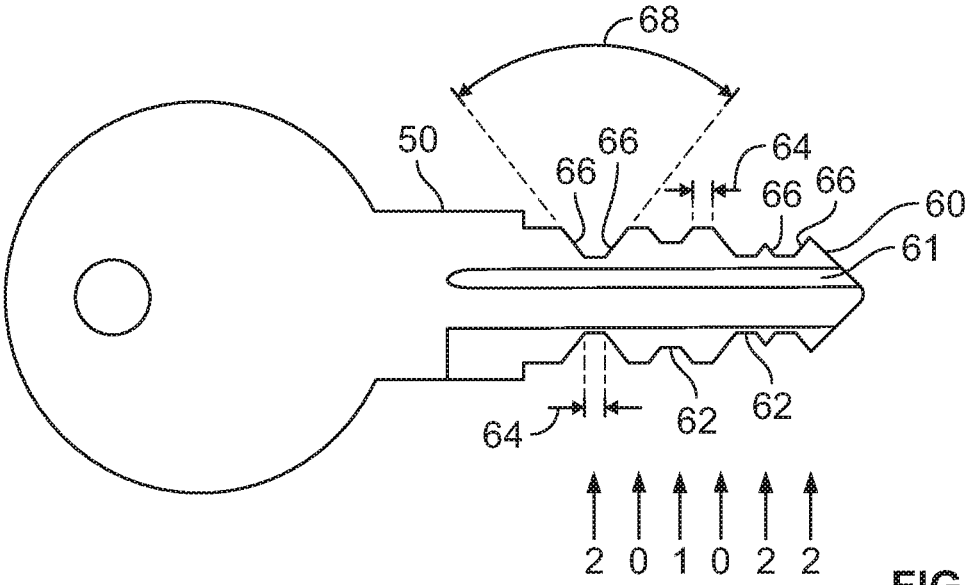
FIG. 7 is a side view of a standard operating key.

FIG. 7 shows a reversible key 50 having a shaft 60 with lands 62 of varying widths positioned along the shaft 60 used for locking and unlocking the lock, also known as a standard key 50. In a preferred embodiment, the shaft has three distinct widths or distances between lands, noted as 0 the widest, 1 an intermediate width and 2 the narrowest. The addition of an additional third standard width between lands increases the number of potential combinations of the lock family. In a preferred embodiment, the distance between the centers of any two adjacent lands, which equates to the distance between the centers of adjacent tumblers 20 is between 0.069 and 0.089 inches. In an even more preferred embodiment, the distance between the centers of adjacent lands and thus the tumblers is between 0.074 and 0.084 inches. In an even more preferred embodiment, the distance between the centers of adjacent lands and thus the tumblers is 0.079 inches. Each of the lands also has a length 64. In one embodiment, this length is between 0.020 and 0.040 inches. As shown in FIG. 5., the tumbler interior openings 42 are sized and located within each respective tumbler 30 to cooperate with a respective land on the shaft 60 of key 50 when the key is fully inserted into the bore 48 so as to retract all of the tumblers from the splines 32, 34, 72 and 78 of the barrel 12 and allow the plug 20 to rotate within the bore 18 when a rotational force is placed on the key 50.

FIG. 7 also shows a slope 68 of the walls 66 of the key shaft 60 between lands. In prior art keys, this slope was generally 90 degrees. In one embodiment of the invention, this slope 68 is between 75 and 85 degrees. In a preferred embodiment, this slope is 80 degrees. It is generally accepted that to make a robust key, the lands, especially those on the outer tips of the 0 widths, must be at least 0.020 inches in length. With a standard prior art 90-degree slope, this would limit the minimum spacing between centers of lands to 0.090 inches.

As can be seen in comparing FIGS. 1 and 2, with this invention, in one embodiment, six double bitted reversible key tumblers 30 can fit into almost the same longitudinal length of a plug as five conventional single bitted tumblers. The industry standard spacing between tumblers is 0.093 inches. Most key machines are designed to use the standard spacing with 90 degree angle cuts. In a preferred embodiment, this new mechanism uses 0.079 inch spacing with 80-degree angle cuts. This not only reduces key interchange and makes key duplication more difficult, but it also makes for a more compact mechanism allowing more tumblers to fit in the same space. This greatly multiplies the amount of combinations available depending on the amount of key land depths used. Moreover, additional tumblers over six are contemplated to provide more pick resistance and more key combinations if additional axial length of the plug 20 can be accommodated.

The new mechanism has independently opposed tumblers (double bitted) instead of single bitted tumblers (see FIG. 2) which are all sprung in the same direction. This increases the pick resistance of the mechanism because the tumblers must be picked in two directions instead of one. The tumblers in this mechanism are independent so they do not work in tandem like many double bitted mechanisms. For example, see U.S. Pat. No. 5,235,832 entitled Locks and Switch Locks Having Substitutable Plug-Type Operator Assemblies, assigned to the assignee of this invention and the disclosure of which is incorporated herein. In this way, even or odd numbers of tumblers can be used depending on space restrictions and number of combinations needed. The increased pick resistance of this design will generally require the use of multiple professional picking tools by a professional locksmith or thief. Moreover, with the additional sixth tumbler, and possible additional key shaft widths, more key combinations are available.

This mechanism is also designed to use a reversible key, which makes it easier to use because the key can be inserted into the lock oriented up or down. However, the key is more difficult to duplicate because of the unique spacing and cutting angle between lands. This also reduces the chances of key interchange with standard locks.

Another advantage of this mechanism is that its components have similar overall dimensions to single bitted locks and it can be used in place of most single bitted lock mechanisms. Different tumbler or plug materials can be used to enhance security even further. For example, hardened steel tumblers can be added to increase drill resistance. This would not be done on most single bitted locks because of the lack of pick resistance. In addition, dust shutters, gaskets and O-rings can be used to increase corrosion resistance and reduce water and dust ingress. This mechanism can be used in plug removable type locks using retaining clips or retaining tumblers because the tumblers are self-staking.

I claim:

1. A lock having a locked condition and an unlocked condition comprising a barrel having a front end and a distal end and a circular internal bore having a first diameter and a longitudinal axis, the bore having a first, a second and a third longitudinal spline, with the first and second longitudinal splines being radially opposed and terminating before the front end of the barrel, and the third longitudinal spline oriented intermediately to the first and second splines, and extending through the front end of the barrel;

a substantially cylindrical plug adapted to reside in the bore, the plug having a substantially rectangular bore, the bore having right and left side walls;

the plug also having a first, a second, and a retaining transverse cylindrical spring pocket, each spring pocket having a diameter and a bottom wall, and a first, a second and a retaining transverse tumbler slot, with each tumbler slot having a depth, the spring pockets and tumbler slots located sequentially along the longitudinal axis with the tumbler slots extending through the bore and the spring pockets alternating between a right side and a left side of the bore, and the diameters of the spring pockets greater than the depth of the tumbler slots;

first, second and retaining tumblers slidably positioned in each respective tumbler slot, each tumbler having an internal opening having a wall and an arm, each arm extending into a respective spring pocket;

a spring mounted in each spring pocket between the bottom wall and a respective tumbler arm for biasing the tumbler radially outwardly with the first and retaining tumblers biased in one direction toward the first spline and the second tumbler biased in the opposite direction toward the second spline, with at least one of the first and second tumblers positioned at least partially in the respective spline in the absence of a key to define a locked condition;

a first reversible key having longitudinal side walls adapted to extend into the plug bore and through the tumbler internal openings, the key having a first and a second land, the lands located to interact with the first and second tumbler internal opening walls when the key is fully inserted into the bore;

wherein, when the first key is fully inserted into the plug bore, the first and second lands move the first and second tumblers against the bias of the respective springs so they retract from the respective splines and the plug can be rotated from the locked condition to the unlocked condition with at least one of the first and second tumblers aligned with the third spline;

a second reversible key having longitudinal side walls adapted to extend into the plug bore and through the tumbler internal openings, the second key having a first, a second and a third land, the lands located to interact with the first, second and retaining tumbler internal opening walls when the key is fully inserted into the plug bore, wherein when the second key is fully inserted into the plug bore while in the unlocked condition, the first and second lands move the first and second tumblers so the respective tumblers are either positioned in the third longitudinal spline or fully retained in the plug, and the third land moves the retaining tumbler to be positioned in the third longitudinal spline, so the plug cannot be rotated in the barrel but can be retracted from the barrel.

2. The lock of claim 1 wherein the first longitudinal spline has a width and a shoulder at its distal end, and the retaining tumbler has a first end that is wider than the width of the first longitudinal spline and is biased into a space beyond the distal end of the first longitudinal spline adjacent the shoulder in the absence of a second key to retain the plug in the barrel.

3. The lock of claim 1 wherein the distance between the centers of two sequential tumbler slots is in the range of 0.069 inches to 0.089 inches.

4. The lock of claim 1 wherein the distance between the centers of two sequential tumbler slots is in the range of 0.074 to 0.084 inches.

5. The lock of claim 1 wherein the distance between the centers of two sequential tumbler slots is 0.079 inches.

6. The lock of claim 1 wherein each of the first and second keys has a slope between any two adjacent lands, and that slope is in the range of 75 degrees to 85 degrees.

7. The lock of claim 1 wherein each of the keys has a slope between any two adjacent lands, and that slope is 80 degrees.

8. The lock of claim 1 wherein the plug bore has stepped sidewalls and the first and second keys each have stepped sidewalls adapted to fit in the plug bore.

9. The lock of claim 1 wherein the plug bore has a protrusion in each sidewall and the first and second keys have splines in each sidewall adapted to accommodate the protrusions.

10. The lock of claim 1 wherein the total number of tumblers is seven.

11. The lock of claim 1 wherein the third spline is oriented at 90 degrees from the first spline.

12. The lock of claim 1 also having a fourth spline diametrically opposed to the third spline, with the fourth spline also having a front wall.

* * * * *